United States Patent [19]

Hanselmann et al.

[11] Patent Number: 4,928,354

[45] Date of Patent: May 29, 1990

[54] METHOD AND APPARATUS FOR REMOVAL OF FIBER FLOCKS FROM FIBER BALES

[75] Inventors: Daniel Hanselmann; Walter Schlepfer, both of Winterthur, Switzerland

[73] Assignee: Sulzer Brothers Limited, Winterthur, Switzerland

[21] Appl. No.: 302,815

[22] Filed: Jan. 26, 1989

[30] Foreign Application Priority Data

Feb. 4, 1988 [CH] Switzerland ..... 00400/88

[51] Int. Cl.[5] ..... D01B 1/00

[52] U.S. Cl. ..... 19/97; 19/80 R

[58] Field of Search ..... 19/80 R, 81, 97

[56] References Cited

U.S. PATENT DOCUMENTS

| | | | |
|---|---|---|---|
| 3,135,022 | 6/1964 | Binder | 19/80 R |
| 4,035,869 | 7/1977 | Wilkes | 19/80 R |
| 4,623,099 | 11/1986 | Vosbein et al. | 19/80 R |
| 4,780,933 | 11/1988 | Pinto et al. | 19/80 R |
| 4,796,335 | 1/1989 | Kranefeld et al. | 19/80 R |

FOREIGN PATENT DOCUMENTS

| | | | |
|---|---|---|---|
| 0058781 | 9/1982 | European Pat. Off. | 19/80 R |
| 0193647 | 9/1986 | European Pat. Off. | 19/80 R |
| 0199041 | 10/1986 | European Pat. Off. | 19/80 R |
| 0263965 | 4/1988 | European Pat. Off. | 19/80 R |
| 2047763 | 12/1980 | United Kingdom | 19/80 R |

*Primary Examiner*—Werner H. Schroeder
*Assistant Examiner*—D. Price
*Attorney, Agent, or Firm*—Kenyon & Kenyon

[57] ABSTRACT

The fiber flock removal apparatus has a pair of removal rolls which may be adjusted in height relative to each other to obtain different depths of penetration into the fiber bales. The removal rolls may rotate codirectionally with the direction of travel or may operate in contra-direction with respect to the direction of travel. The rolls may be mounted individually for vertical movement relative to each other or may be mounted in a common removal means which is pivotal about a horizontal axis to achieve adjustability in the relative heights of the removal rolls. In one embodiment, the rolls are maintained in a common horizontal plane while grid bars are angularly adjusted to obtain different depths of penetration of the removal rolls into the fiber bales.

23 Claims, 7 Drawing Sheets

METHOD AND APPARATUS FOR REMOVAL OF FIBER FLOCKS FROM FIBER BALES

This invention relates to a method and apparatus for removing fiber flocks from fiber bales.

As is known, various techniques have been employed for the removal of fiber flocks from fiber bales such as cotton or man-made fiber bales and the like. For example, U.S. Pat. No. 4,035,869 describes an apparatus for supplying fibers to fiber processing apparatus, especially seed cotton to cotton gins. The apparatus is described as having a generally horizontal bed along which fiber-laden pallets are translated from a loading zone to a discharge zone. The fibers on each pallet are engaged by rotary breakers which loosen and remove the bulk of the fibers from each pallet which are then discharged onto a conveyor system for subsequent processing apparatus.

U.S. Pat. No. 3,135,022 describes a bale rasp for reducing hard pressed fiber bales. As described, the rasp comprises two rasp elements rotating in opposite directions which alternately engage a reciprocating bale so that the direction of the circumferential movement of the individual rasp element coincides with the direction of movement of the bale. The rasp elements are carried by a rocker which is rocked in synchronism with the reciprocating movement of the bale. However, due to the rocking of the rocker, only one rasp element engages the bale at a time when the bale moves in direction in which the teeth of the rasp element are directed.

European patent application Ser. No. 0263965 describes a millhead of a fiber bale mill wherein a single mill rotor removes fibers from the surface of a bale for transport to a combing rotor which returns fibers of excessive size back to the bale surface. It has been known from practice that removal rolls may rotate contra-directionally in the known double-roll bale openers. That is, the leading removal roll as considered in the direction of travel rotates "co-directionally" with the direction of travel in order to detach fiber flocks from the bale surface during this co-directional movement. The trailing roll as considered in the direction of travel correspondingly rotates in the opposite direction and detaches fiber flocks from the same surface. However, it has also been known that the removal of fiber flocks in the contra-direction has a poorer opening efficiency in terms of quantity than a roll which rotates co-directionally.

Removal means are also known wherein an opener roll may have the direction of rotation reversed so that the roll may rotate co-directionally depending upon the direction of travel of the removal means over the row of bales.

The known double-roll arrangement provides the opportunity of detaching flocks with a reciprocating movement of the removal means without having to change the direction of rotation of the removal rolls. This is because the leading roll as considered in the direction of travel is always rotating co-directionally. However, it has been practically impossible to increase the flock removal output in comparison with a single-roll removal means due to the poor quantitive efficiency of the contra-direction removal roll.

One improvement of the flock removal output of a double-roll arrangement lies in the possibility of having both rolls rotate co-directionally in each direction of travel. However, this requires giving the rolls the opposite direction of rotation for the return movement or lifting the removal means from the surface of the bales so that the fiber flocks can be detached only in one direction of travel. In the latter case, however, any increase in output is rather problematic even with a rapid return travel since, depending on the length of the row of bales, some period of time exists. during which no fiber flocks are removed.

Another means of increasing output is, of course, to increase the roll length correspondingly using removal means having a single roll or two rolls. However, the disadvantage of such a construction is that a rather wide projection of the removal means results on the carrier accommodating the removal means so that the entire system is subject to a higher mechanical loading.

Accordingly, it is an object of the invention to increase the removal output of an apparatus for removing fiber flocks from fiber bales irrespective of removal roll length.

It is another object of the invention to increase the efficiency of a fiber removal apparatus.

It is another object of the invention to improve the efficiency of fiber removal from a row of fiber bales.

Briefly, the invention provides a method and apparatus for removing fiber flocks from a row of fiber bales.

The method comprises the steps of passing at least a pair of parallel rotating removal rolls over the fiber bales for removing fiber flocks from the bales and of maintaining the rolls at different levels from each other during travel over the bales in order to obtain different depths of penetration of the rolls into the fiber bales. In this respect, the trailing roll of any two rolls relative to the direction of travel has a greater depth of penetration than a leading roll.

In accordance with the method, the depth of penetration of each roll can be adjusted in dependence on the density of a respective bale.

The removal rolls may be rotated in the same direction relative to each other or may be rotated in opposite directions relative to each other. Further, the leading roll of a roll set may be rotated co-directionally with the direction of movement of the rolls. Alternatively, the rolls may be rotated contra-directionally relative to the direction of movement of the rolls.

The apparatus for removing the fiber flocks comprises a removal means in the form of a roll support having at least a pair of parallel rotatable removal rolls for removing fiber flock from a row of fiber bales as well as a carrier for moving the removal means over the row of fiber bales. In accordance with the invention, a means is provided for adjusting the level of at least one roll relative to the other rolls of the removal means in order to obtain different depths of penetration of the rolls in the fiber bales.

In one embodiment, the removal means is pivotally mounted on the carrier and the means for adjusting the level of the rolls is connected to the removal means to pivot the removal means relative to the carrier in order to adjust the height of the rolls.

In another embodiment, the means for adjusting the level of at least one roll relative to the other rolls includes a roll carrier which is mounted in the carrier for vertical movement so as to adjust the depth of penetration of the rolls mounted thereon.

Each removal roll may be comprised of a plurality of toothed discs disposed in spaced relation coaxially of the roll to define gaps therebetween. In this case, grid bars may extend longitudinally of the rolls within the gaps of the rolls to rest on the top surfaces of the fiber bales. These grid bars may also be connected to the means for adjusting the level of the rolls so that the grid bars are also adjusted relative to the level of at least one of the rolls.

In another embodiment, the removal rolls may be maintained in a common horizontal plane while the grid bars which extend longitudinally of the rolls within gaps between toothed discs of the rolls are connected with a means for adjusting the angular disposition of the grid bars relative to the rolls so as to obtain different depths of penetration of the rolls into the fiber bales. One advantages of the various constructions is that the different depths of penetration of the rolls into the fiber bales enables the removal rolls to utilize the full removal depth so that in a two-roll arrangement, there is an effective doubling of the removal capacity. Another advantage is that small flocks can be removed with a removal capacity equivalent to one roll since the flock size is, of course, increased with increasing depth of penetration per passage of the removal means, something which is not always desirable. In other words, for the same depth of penetration, double or multiple output can be obtained with a double or multiple roll arrangement as compared with a single roll arrangement or, alternatively, for a given output, the flock size can be reduced by reducing the depth of penetration.

The apparatus may also include a means for raising and lowering the removal means relative to a row of fiber bales.

These and other objects and advantages of the invention will become more apparent from the following detailed description taken in conjunction with the accompanying drawings wherein.

Figure 11:
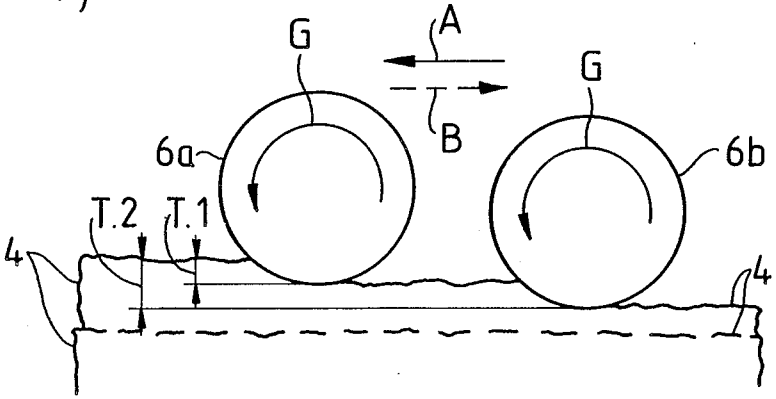
Figure 12:
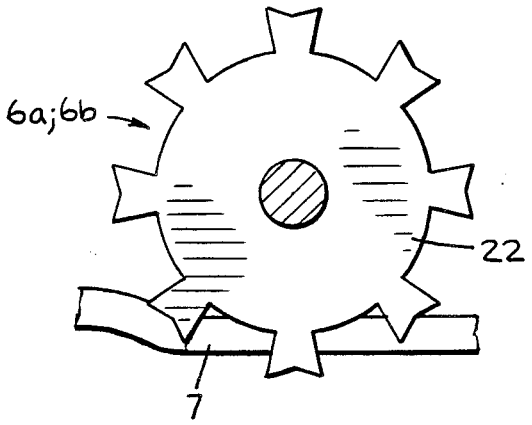
Figure 13:
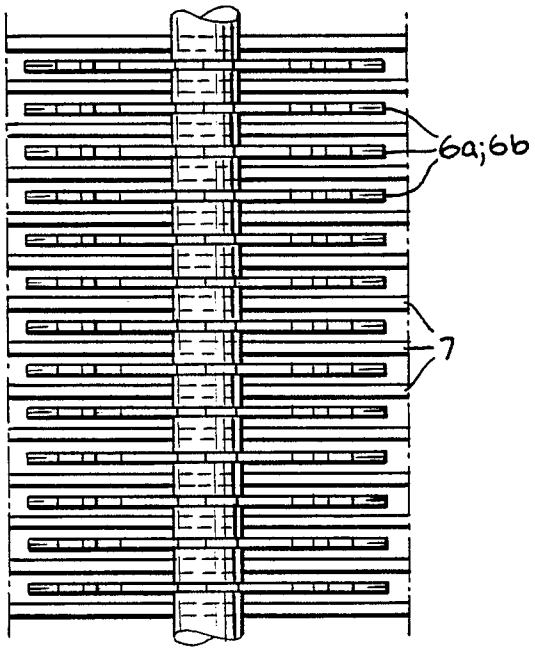

FIG. 11 schematically illustrates the geometric relationship between a pair of removal rolls during operation in accordance with the invention;

FIG. 12 illustrates a side view of a removal roll and grid bar employed in the apparatus of the invention; and FIG. 13 illustrates a partial plan view of a removal roll in accordance with the invention.

Figure 1:
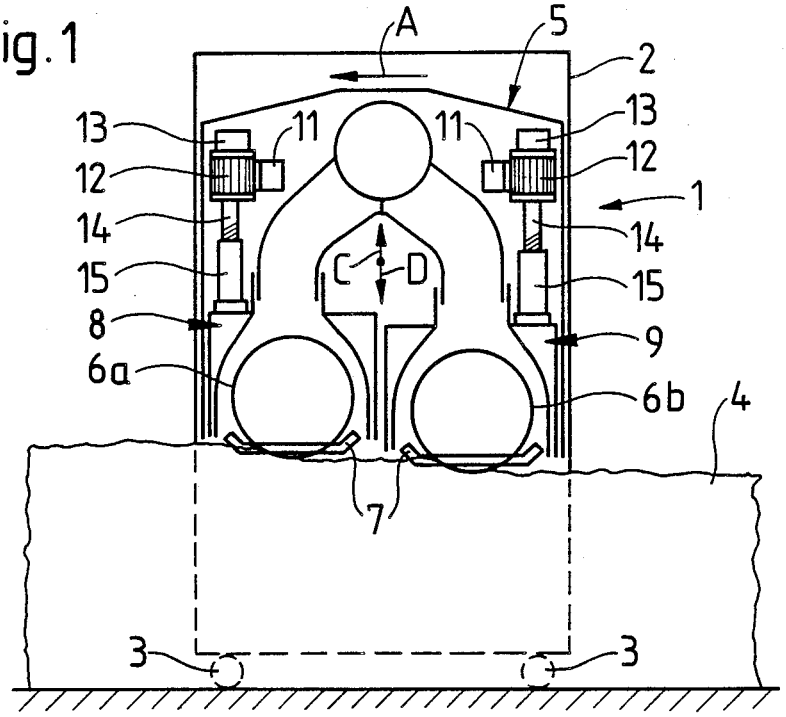
FIG. 1 illustrates a semi-diagrammatic elevational view of an apparatus constructed in accordance with the invention.

Referring to FIG. 1 the apparatus 1 for removing fiber flocks includes a carrier 2 which travels by means of wheels 3 on rails (not shown) along a row of fiber bales 4 in the direction A (FIG. 1). As indicated in FIG. 2, the carrier 2 is also movable in the opposite direction as indicated by the arrow B.

Referring to FIG. 1, the carrier 2 supports a removal means 5 which is positioned to move over the row of fiber bales 4. As indicated, the removal means 5 has a pair of parallel rotatable removal rolls 6*a*, 6*b* for removing fiber flock from the fiber bales 4. Each roll 6*a*, 6*b* is of known construction, such as described in European patent application Ser. No. 0058781 and includes a plurality of toothed discs 22, as shown in FIGS. 12 and 13 disposed in spaced relation coaxially of the roll in order to define gaps therebetween. In addition, grid bars 7 extend longitudinally of the rolls 6*a*, 6*b* within the gaps between the discs 22.

The apparatus 1 is provided with mean for raising and lowering the removal means 5 in the direction indicated by the arrows C, D relative to the fiber bales 4 in order to obtain a predetermined depth of penetration of the rolls 6*a*, 6*b* in the fiber bales 4. In addition, a means is provided for adjusting the level of at least one roll 6*a*, 6*b* relative to the other roll in order to obtain different depths of penetration of the rolls in the fiber bales. This latter means includes a pair of roll carriers 8, 9 in which the The removal rolls 6*a*, 6*b* are mounted so as to be rotatable and drivable. Grid bars 7 are also mounted on the carriers 8, 9 so as to be movable as explained below with respect to FIG. 5 or stationary as explained below with respect to FIG. 6.

Figure 2:
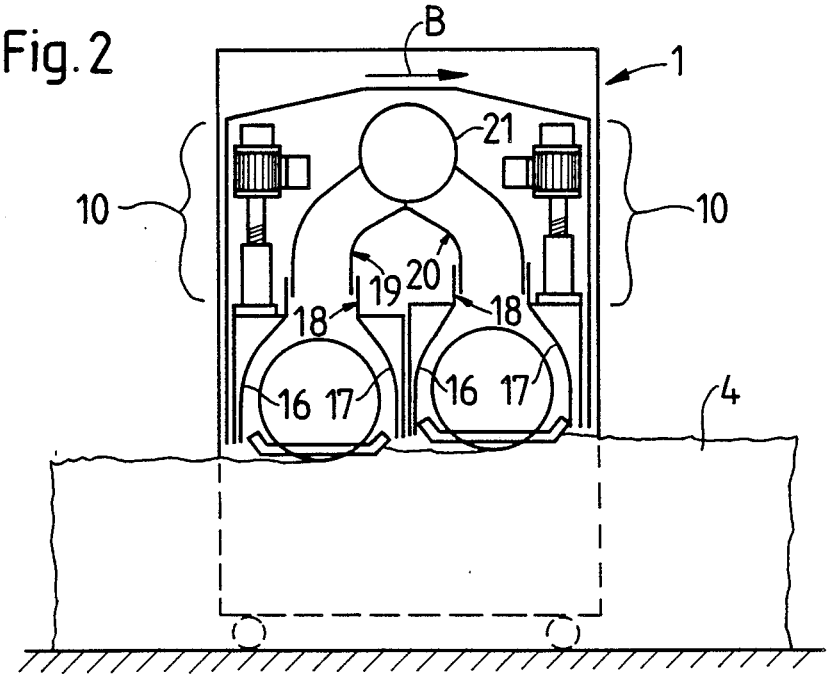
FIG. 2 illustrates a view of the apparatus of FIG. 1 taken during travel in an opposite direction.

As shown, the roll carrier 8, 9 for mounting each respective roll 6*a*, 6*b* is mounted in the carrier 2 for vertical movement on guide rails (not shown) via a servomotor drive 10 (FIG. 2). As indicated in FIG. 1, each drive 10 includes a geared motor 12 fixed on the removal means 5 by means of a bracket 11 and a rotational pulse transmitter 13. The geared motor 12 has an output shaft 14 which is guided in a spindle bush 15 fixed on a respective roll carrier 8, 9. Thus, upon activation of the drive 10, the output shaft 14 rotates as a spindle so as to raise or lower the spindle bush 15 and, consequently, the roll carrier 8, 9 attached thereto.

The rotational pulse transmitters 13 connected to the respective motors 12 serve to emit signals for adjusting the level of one roll relative to the other roll in order to obtain a different depth of penetration of the rolls 6*a*, 6*b* in the fiber bales. That is, depending upon a signal directed to a respective transmitter 13, the roll carrier 8, 9 for a given roll 6*a*, 6*b* may be raised or lowered a greater amount than the other roll carrier.

Referring to FIG. 2, each roll carrier 8, 9 has a pair of curvilinear guide plates 16, 17 mounted thereon which lead into an outlet duct 18 at the top, as viewed. In addition, suction ducts 19, 20 engage in the respective outlet ducts 18 with minimum clearance therebetween in order to generate a negative pressure which is required in the surroundings of the rolls 6*a*, 6*b* for suction extraction of the fiber flock conveying air. The outlet ducts 18 and suction ducts 19, 20 extend at least over the entire length of the roll 6*a*, 6*b* and communicate with a suction pipe which is, in turn, connected to a negative pressure source (not shown) to produce the fiber flock conveying air stream. This suction pipe 21 may be conical such that the diameter increases towards the source of negative pressure in order to maintain a substantially uniformly extracted quantity of air over the entire length corresponding to the removal roll 6a, 6b. The source of negative pressure is known per se and is therefore not further explained in detail.

The removal means 5 may also be modified so that only the roll carriers 8, 9 are movable up and down and not the entire removal means 5. In this case, the outlet ducts 18 and the suction ducts 19, 20 would be telescopic in construction and the output shafts 14 of the servomotor drives 10 would require a corresponding lengthing. In this case, the removal means 5 would be mounted in a stationary manner within the carrier 2. In addition, the grid bars 7 would form part of the roll carriers 8, 9 and would be fixed as indicated in either of FIGS. 5 and 6.

Figure 3:
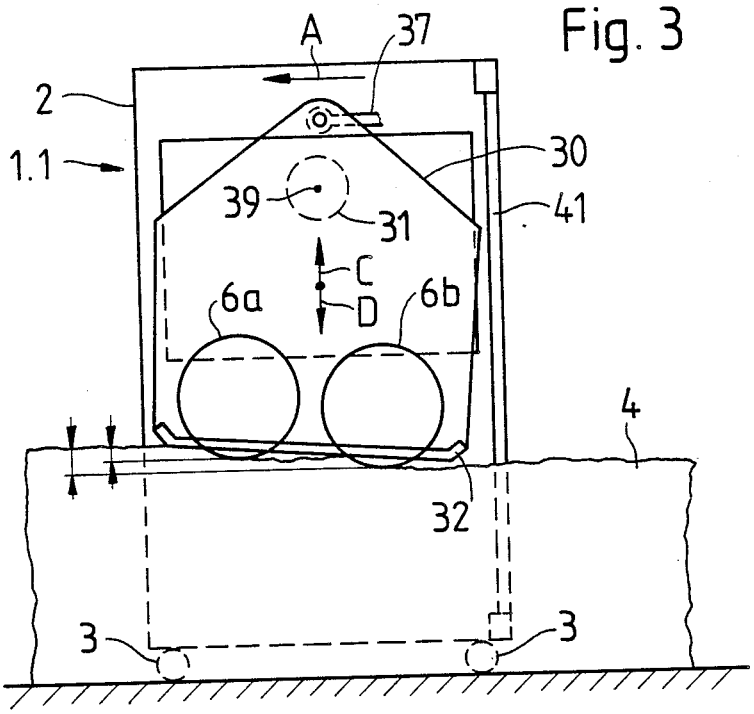
FIG. 3 illustrates a modified apparatus utilizing a pivotally mounted removal means in accordance with the invention.
Figure 4:
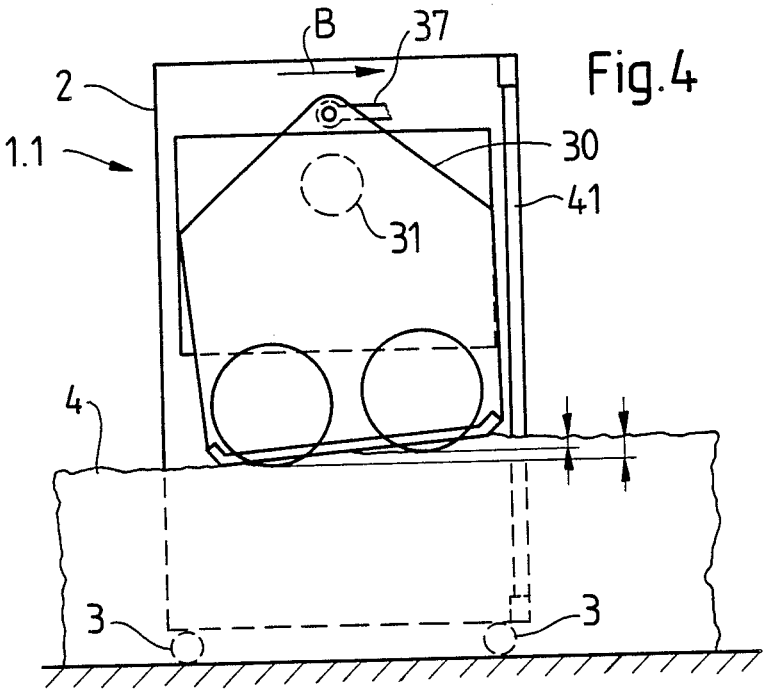
FIG. 4 illustrates a view similar to FIG. 3 of the apparatus during travel in an opposite direction.
Figure 7:
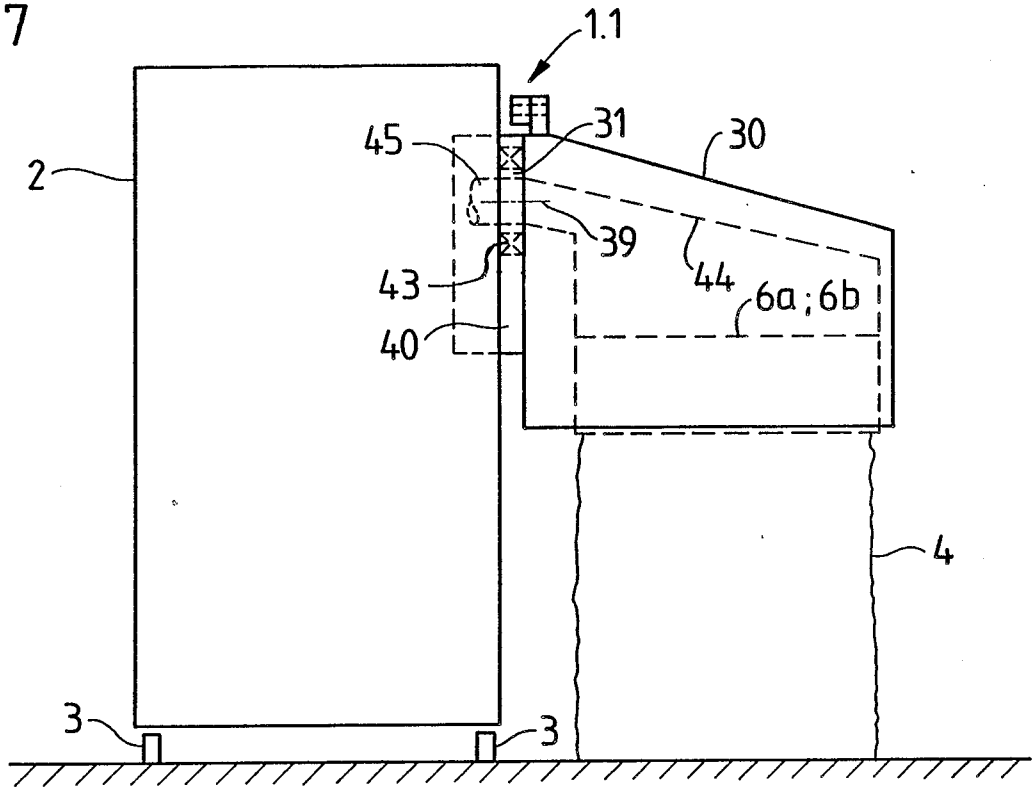
FIG. 7 illustrates a side view of the removal apparatus of FIGS. 3 and 4.

Referring to FIGS. 3 and 4, wherein like reference characters indicate like parts as above, the apparatus 1.1 includes a carrier 2 in which the removal means 30 is in the form of a roll support in which a pair of rotatable and drivable removal rolls 6a, 6b are arranged to be stationary with respect to the removal means 30. As indicated, the removal means 30 is pivotally mounted on the carrier 2 by means of a hollow pivot shaft 31 which rotates about a horizontal axis of rotation 39. The pivot shaft 31 is received in a pivot bearing 45 (see FIG. 7) which is provided in a slide 40. The slide 40 is connected with a suitable means for raising and lowering the slide 40 and, thus, the removal means 30, as is described in European patent application Ser. No. 0193647.

In order to guide the air stream for conveying the fiber flocks, the removal means 30 also comprises an air guide duct 44 (see FIGS. 6 and 7) which extends over the entire length of the removal rolls 6a, 6b and is connected to a suction tube 43 (FIG. 6) which, in turn is connected to a source negative pressure (not shown).

Figure 6:
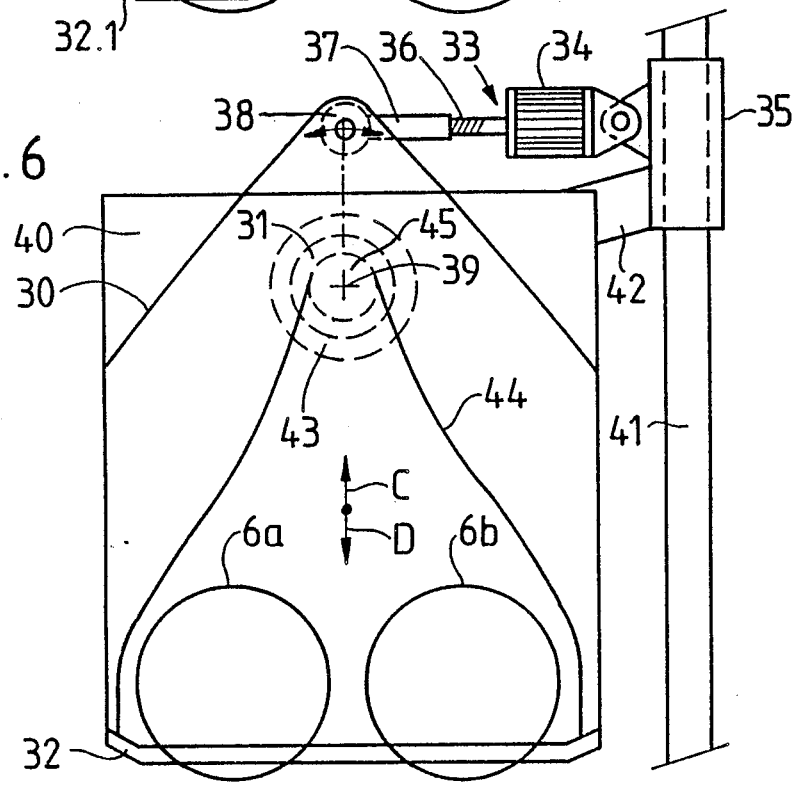
FIG. 6 illustrates a view similar to FIG. 4 of a pivotally mounted removal means having grid bars in accordance with the invention.

Referring to FIG. 6, the removal means 30 is connected with means for adjusting the level of one roll relative to the other roll in order to obtain different depths of penetration of the rolls 6a, 6b in the fiber bales. In this embodiment, the adjusting means includes a pivot mechanism which is connected to the upper end of the removal means 30 in order to pivot the removal means 30 about the axis of rotation 39. This pivot mechanism includes a servomotor drive 33 having a geared motor 34 which is pivotally mounted at one end on a sliding element 35 which, in turn, is movable up and down with the removal means 30 in the directions indicated by the arrows C, D on a stationary guide tube 41. At the opposite end, the motor 34 has an output shaft in the form of a spindle 36 which rotates within a spindle bush 37 pivotally secured to the removal means 30 by a pivot bearing 38. Thus, upon actuation of the motor 34, the spindle 36 is able to rotate so as to pivot the removal means 30 clockwise or counter clockwise about the axis 39. In this way, the relative heights of the rolls 6a, 6b may be adjusted relative to each other.

As indicated in FIG. 6, the sliding element 35 is connected to the slide 40 by way of a bracket 42.

As indicated in FIG. 6 grid bars 32 are provided longitudinally of the rolls 6a and 6b and are fixed on the removal means 30 so as to pivot therewith.

Figure 5:
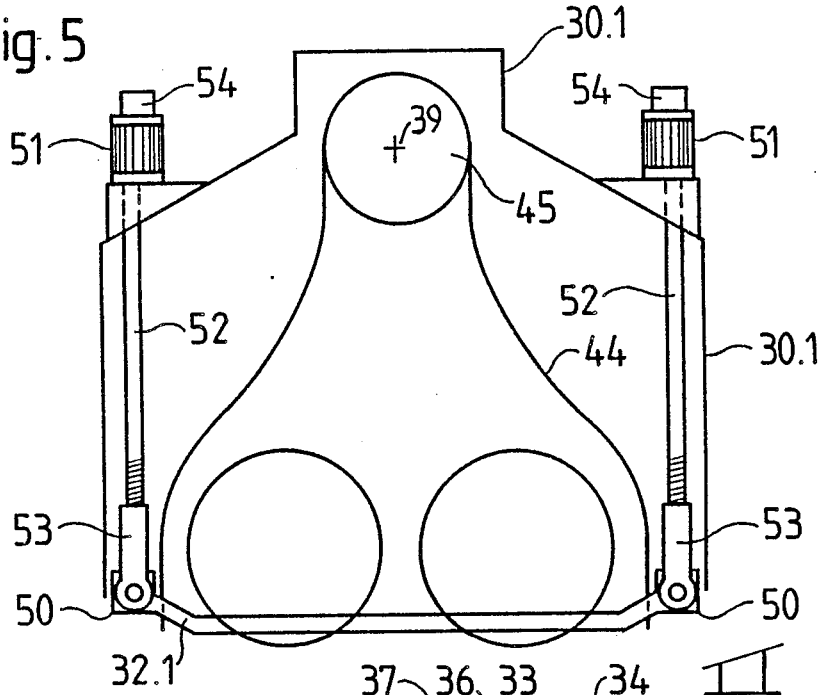
FIG. 5 illustrates a semi-diagrammatic elevational view of a removal apparatus in accordance with the invention employing grid bars.

Referring to FIG. 5, wherein like reference characters indicate like parts as above, the removal means 30.1 may be provided with grid bars 32.1 which are independently adjustable relative to the removal rolls. To this end, the grid bars 32.1 are secured to longitudinal members 50 which, in turn, are movable relative to the removal rolls by means of a lifting mechanism pivotally secured thereto. The lifting mechanism comprises geared stepping motors 51 which drive screw spindles 52, which, in turn, rotate within spindle bushes 53 pivotally connected to the longitudinal members 50. Such a lifting mechanism is otherwise described in European paten application Pat. No. 0199041 and need not be further described. Of note, two lifting devices are provided for each longitudinal member 50. Also, the geared stepping motors are provided with rotational pulse transmitters 54 by means of which the position of the grids 32.1 can be preset by a control system (not shown) of known construction.

Of note, the removal means 30.1 may be pivoted about an axis of rotation 39 in the same manner as the removal means 30 of FIG. 6.

Figure 8:
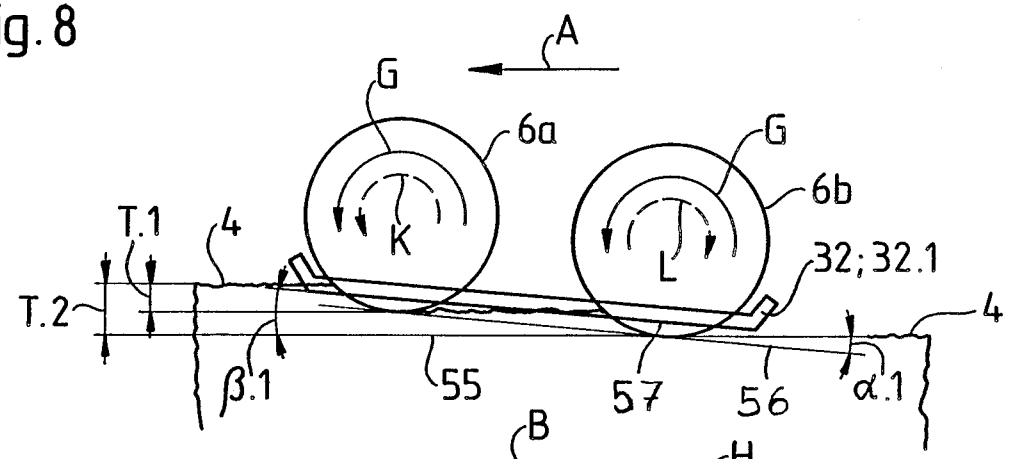
FIG. 8 illustrates a schematic view of a pair of removal rolls and a grid bar during travel in one direction in accordance with the invention.

Referring to FIG. 8, when the removal means 30 is used, the pivot angle a.1 of the removal rolls 6a, 6b arising from the pivoting of this removal means has the same value as the pivot angle b.1 of the grid bars 32. In these conditions, the angle a.1 is formed by an imaginary plane 56 abutting the periphery of the removal rolls 6a and 6b, while on the other hand, the angle b.1 is formed by the horizontal plane 55 and an imaginary plane 57 containing the bottom surface of the grid bars 32; 32.1 penetrating the bale surface. The pivot angle a.1 is usually so selected that the depth of penetration T.1 of the leading removal roll 6a is about half the depth of penetration T.2 of the trailing removal roll 6b. The term "depth of penetration" denotes the extent to which the associated removal roll penetrates with respect to the bale surface in front of the removal means 30. This applies whether the carrier moves in the direction A (FIG. 3) or in the direction B. Also, when the removal means 30 is in use, the angle a is equal to the angle b.

Figure 9:
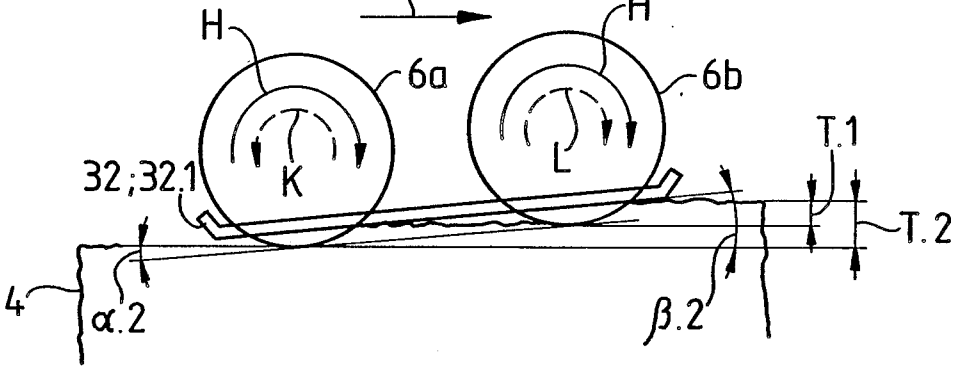
FIG. 9 illustrates a view of the removal rolls and grid bar of FIG. 8 during travel in an opposition direction in accordance with the invention.

FIG. 9 shows the same but for the direction of travel B. The remarks in connection with the angles a.1 and b.1 therefore also apply to the angles a.2 and b.2 respectively.

If, in a likewise possible variant, the suspension of the grid bars 32.1 in FIG. 5 is combined with a pivotable removal means, corresponding to the removal means 30 in FIG. 6, it is possible to choose different values for the angles a.1, a.2 respectively and b.1, b.2 respectively (FIG. 8). The arrows G (FIG. 8) and H (FIG. 9) respectively showing the direction of rotation indicate that, in the case of FIG. 8, the removal rolls having the direction of rotation G and the direction of rotation H in FIG. 9 rotate "co-directionally" with the direction of travel A and B, respectively. On the other hand, when the removal rolls 6a, 6b rotate in the directions K and L, the removal roll 6a in the case of FIG. 8 is co-directional and the removal roll 6b is contra-directional, whereas in the example shown in FIG. 9 the removal roll 6b rotates co-directionally and the removal roll 6a contra-directionally.

Figure 10:
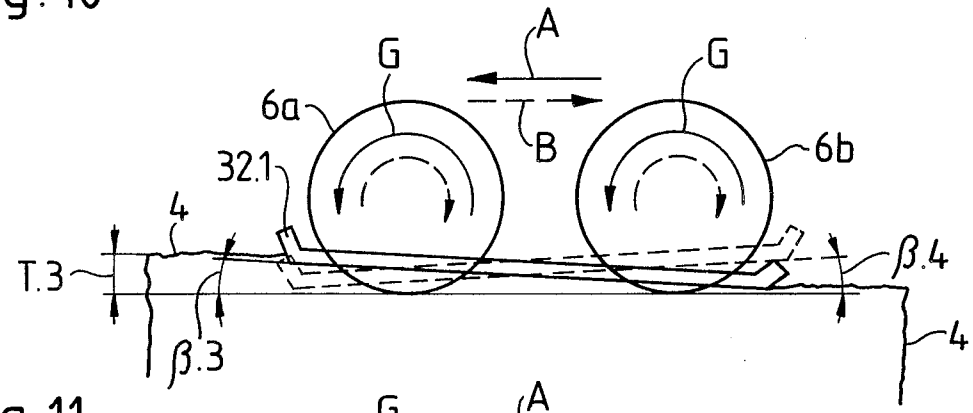
FIG. 10 illustrates a schematic view of a pair of parallel removal rolls with an adjustable grid bar in accordance with the invention.

Referring to FIG. 10, wherein like reference characters indicate like parts as above, the removal rolls 6a, 6b may be mounted so as to be maintained in a horizontal plane while the grid bars 32.1 are adjusted angularly so as to obtain different depths of penetration of the rolls 6a, 6b into the fiber bales. As indicated, the gird bars 32.1 may be adjusted to an angle 30.3 for the direction of travel A and a reverse angle 30.4 relative to the direction of travel b. In these conditions, the directions of rotation G, H or K and L may be selected.

FIG. 11 shows the use of the removal means 5 of FIGS. 1 and 2 but only for the direction of travel A. The depths of penetration T.1, T.2 are individually selectable and can be obtained alternately on the return travel B if locks are removed in both directions of travel.

Of note, the arrow B shown in double broken lines and the row of bales 4 shown in broken lines in FIG. 11 indicate a variant which is possible with all of the removal means 5, 30, 30.1 wherein the removal means are lifted away from the bale surface on the return travel and always have the same inclination. In this way, fiber flocks are removed from the bales only in the direction A. This variant may be useful when it is intended always to remove the mixture inside the row of fiber bales from the same side. A fixed inclined position of the removal rolls can also be selected for a variant of this kind.

In addition, the principle on which the removal means and grid bars operates may be combined with the principle described in European patent application Ser. No. 0193647 which describes a change in the feed depth of the removal means per passage with increasing fiber bale density. That is, the depth of penetration may be reduced in order to make the output uniform and, secondly, to detach fiber flocks from the fiber bales in an undamaged condition. This means that the depths of penetration T.1, T.2 can also be varied correspondingly with increasing fiber bale density. The apparatus required for this purpose is described in European patent application Ser. No. 0193647 and need not be further described.

Of note, the removal apparatus may be constructed to utilize three or more removal rolls. Further, the apparatus may be constructed to utilize only removal rolls without grid bars.

The invention thus provides an apparatus which can be used to efficiently remove fiber flocks from a row of fiber bales.

What is claimed is:

1. A method of removing fiber flocks from a row of fiber bales, said method comprising the steps of passing at least a pair of parallel rotating removal rolls over the fiber bales for removing fiber flocks from the bales: and maintaining the rolls at different levels from each other during travel over the bales to obtain different depths of penetration of the rolls into the fiber bales.

2. A method as set forth in claim 1 wherein a trailing roll of said rolls relative to the direction of travel is maintain at a greater depth of penetration than a leading roll of said rolls.

3. A method as set forth in claim 1 which further comprises the step of adjusting the depth of penetration in dependence on the density of a respective bale.

4. A method as set forth in claim 1 which further comprises the step of rotating the rollers in the same direction relative to each other.

5. A method as set forth in claim 1 which further comprises the step of rotating the rollers in opposite directions relative to each other.

6. A method as set forth in claim 1 which further comprises the step of rotating the leading roll of said rolls co-directionally with the direction of movement of said rolls.

7. A method as set forth in claim 1 which further comprises the step of rotating the rollers contra-directionally relative to the direction of movement of said rolls.

8. An apparatus for removing fiber flocks from a row of fiber bales, said apparatus comprising a removal means including at least a pair of parallel rotatable removal rolls for removing fiber flock from the fiber bales;

a carrier for moving said removal means over the row of fiber bales; and second means for adjusting the level of at least one roll relative to the other roll to obtain different depths of penetration of said rolls in the fiber bales.

9. An apparatus as set forth in claim 8 wherein said removal means is pivotally mounted on said carrier and said second means is connected to said removal means to pivot said removal means relative to said carrier to adjust the height of said rolls.

10. An apparatus as set forth in claim 8 wherein each roll comprises a plurality of toothed discs disposed in spaced relation coaxially of said roll to define gaps therebetween and which further comprises grid bars extending longitudinally of said carrier within said gaps of said rolls to rest on the fiber bales.

11. An apparatus as set forth in claim 10 wherein said second means is connected to said grid bars for adjusting said bars relative to the level of at least one of said rolls.

12. An apparatus as set forth in claim 10 which further comprises third means for adjusting said grid bars angularly relative to the fiber bales.

13. An apparatus as set forth in claim 8 which further comprises means for lowering said removal means relative to the row of fiber bales to obtain a predetermined depth of penetration of said rolls in the fiber bales.

14. An apparatus for removing fiber flocks from a row of fiber bales, said apparatus comprising at least a pair of parallel rotatable removal rolls for removing fiber flock from the fiber bales;

a carrier for moving said rolls over the row of fiber bales; and means for adjusting the level of at least one roll relative to the other rolls to obtain different depths of penetration of said rolls in the fiber bales.

15. An apparatus as set forth in claim 14 wherein said means includes a roll carrier mounted in said carrier for vertical movement, said roll carrier having one roll mounted therein.

16. An apparatus as set forth in claim 14 wherein each roll includes a plurality of toothed discs disposed in spaced relation to define gaps therebetween and which further comprises grid bars extending within said gaps and secured to said roll carrier for movement therewith.

17. An apparatus as set forth in claim 14 which further comprises a roll support having said rolls mounted therein, said roll support being pivotally mounted and connected to said second means for pivoting thereby.

18. An apparatus as set forth in claim 14 which further comprises means for raising and lowering said rolls relative to the row of fiber bales.

19. An apparatus as set forth in claim 14 wherein each roll includes a plurality of spaced apart toothed discs for penetrating in top the fiber bales and which further comprises a plurality of grid bars extending longitudinally between said discs to rest on the fiber bales.

20. An apparatus as set forth in claim 19 which further comprises means for angularly adjusting said grid bars in a vertical plane.

21. An apparatus for removing fiber flocks from a row of fiber bales, said apparatus comprising at least a pair of parallel rotatable removal rolls for removing fiber flock from the fiber bales, each roll having a plurality of coaxial spaced toothed discs defining gaps therebetween;

a plurality of grid bars extending longitudinally of said rolls within said gaps; and means for adjusting the angular disposition of said grid bars relative of said rolls and a row of fiber bales to obtain different depths of penetration of said rolls into the fiber bales.

22. An apparatus as set forth in claim 21 wherein said rolls are disposed in a common horizontal plane.

23. An apparatus as set forth in claim 22 which further comprises means for raising and lowering said rolls and grid bars relative to a row of fiber bales.

* * * * *

UNITED STATES PATENT AND TRADEMARK OFFICE

CERTIFICATE OF CORRECTION

PATENT NO. : 4,928,354

DATED : May 29, 1990

INVENTOR(S) : DANIEL HANSELMANN, et al

It is certified that error appears in the above-identified patent and that said Letters Patent is hereby corrected as shown below:

In the cover page, [73] change the Assignee from "SULZER BROTHERS LIMITED" to -RIETER MACHINE WORKS, LTD.-
Column 6, line 6 "paten" should be -patent-
Column 7, line 50 "maintain" should be -maintained-
Column 8, line 61 "in top" should be -into-

Signed and Sealed this

Tenth Day of March, 1992

*Attest:*

HARRY F. MANBECK, JR.

*Attesting Officer*

*Commissioner of Patents and Trademarks*